United States Patent [19]

Scheben et al.

[11] 3,930,565

[45] Jan. 6, 1976

[54] COLUMN OF ADJUSTABLE HEIGHT

[75] Inventors: Hans Scheben, Koblenz-Rubenach; Herbert Freitag, Koblenz-Metternich, both of Germany

[73] Assignee: Stabilus GmbH, Koblenz, Germany

[22] Filed: Feb. 13, 1975

[21] Appl. No.: 549,833

Related U.S. Application Data

[63] Continuation-in-part of Ser. No. 343,400, March 21, 1973, abandoned.

[30] Foreign Application Priority Data

Mar. 23, 1972 Germany ..... 2214170

[52] U.S. Cl. ..... 188/300; 74/107; 188/299; 188/322; 248/354 H; 297/355

[51] Int. Cl.[2] ..... F16F 9/32

[58] Field of Search ..... 188/299, 300, 319, 322; 74/102, 103, 107, 99 R; 248/354 H; 297/355

[56] References Cited

UNITED STATES PATENTS

| | | | |
|---|---|---|---|
| 1,454,367 | 5/1923 | Yardley | 74/107 |
| 2,630,887 | 3/1953 | Paquin | 188/300 |
| 3,223,206 | 12/1965 | Bainbridge et al. | 188/300 |

FOREIGN PATENTS OR APPLICATIONS

| | | | |
|---|---|---|---|
| 1,287,276 | 1/1969 | Germany | 188/300 |

*Primary Examiner*—George E. A. Halvosa
*Attorney, Agent, or Firm*—Hans Berman; Kurt Kelman

[57] ABSTRACT

In a column of telescopically adjustable height, the two coaxial telescoping members may be adjusted axially after a control button in an axial bore of one member is depressed. A bracket, longitudinally split into two members, passes into the bore through a radial opening of the one column member and is anchored axially and radially by conforming engagement with the column member. The operating lever for the control button is pivoted between the bracket members outside the column bore so that a small angular movement of the exposed lever part causes the terminal part of the lever in the bore abuttingly to engage the control button and to depress the same.

15 Claims, 11 Drawing Figures

COLUMN OF ADJUSTABLE HEIGHT

This application is a continuation-in-part of the copending application Ser. No. 343,400, filed Mar. 21, 1973, now abandoned.

This invention relates to columns of adjustable height, and particularly to a column having an improved operating arrangement for releasing the two telescopically engaged, coaxial parts of the column for relative length-adjusting movement.

It is known to support chair seats and the like on single adjustable columns essentially consisting of two coaxial, telescopically engaged members held in their relative axial position by a fluid filling two compartments in the column normally sealed from each other by a valve. When the valve is opened by means of a control element accessible outside the column, fluid may flow between the compartments, and the effective length of the column may be changed by axially shifting the column members relative to each other.

In a known column of the afore-described type (see German Pat. No. 1,208,557 and published German Patent Application No. 1,958,874), the control element projects axially from the upper column element and is depressed to open the valve in the column. If a chair seat is mounted on the upper column member, the control element is not conveniently available for direct manual operation, and it has been proposed to mount a bracket on the column, and to pivot a lever on the bracket in such a manner that one conveniently accessible lever arm may be pivoted upward for the other lever arm to depress the control button.

The known operating arrangement is effective, but it is ethetically less than satisfactory because of the relatively bulky bracket on the outside of the column. The known bracket is welded to the column, an operation which is relatively costly and must be performed before the column is finished by electroplating or the like.

An object of the invention is the provision of a column of adjustable height equipped with as inconspicuous an operating arrangement as possible. Another object is the provision of an operating arrangement which may be assembled with the otherwise finished column without marring the column.

With these and other objects in view, as will presently become apparent, the column of the invention includes two column members elongated in the direction of a common axis and movable relative to each other in this direction in telescoping engagement. One of the members is formed with an axial bore and an axially closed, radial opening communicating with the bore. A control element is mounted on the one column member in the bore of the latter for axial movement between a locking position in which relative axial movement of the column members is substantially prevented, and a releasing position in which the members are free to move relative to each other.

An elongated bracket has a first longitudinal portion which abuttingly engages the one column member in the radial opening of the same and thereby prevents movement of the bracket in an axial direction. A second longitudinal portion abuttingly engages the one column member in its bore and thereby prevents radial movement of the bracket outward of the opening. Respective terminal parts of an operating member are in the bore and outside the same, the operating member passing through the aforementioned opening. The operating member is secured to the bracket in such a manner that the terminal part of the operating member in the bore may move axially in abutting engagement with the control element and thereby move the latter between its locking and releasing positions.

Other features and many of the attendant advantages of this invention will readily be appreciated as the same becomes better understood by reference to the following detailed description of preferred embodiments when considered in connection with the appended drawing in which.

Figure 1:
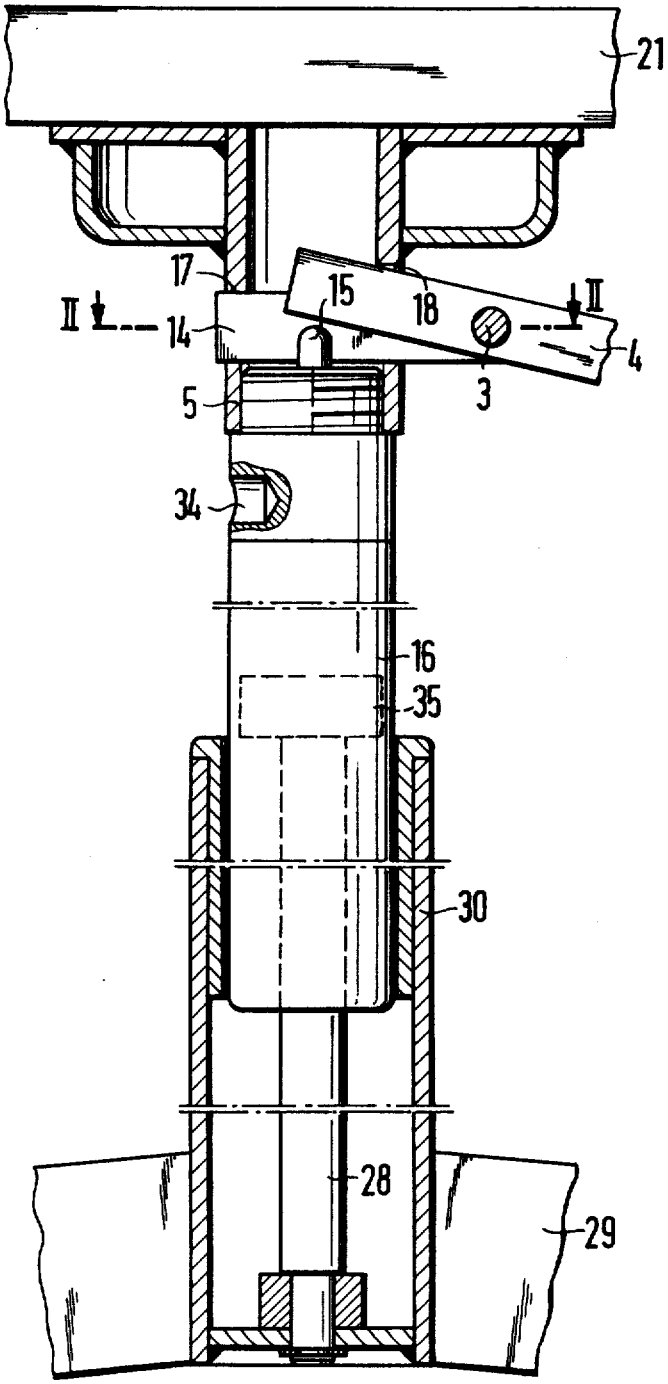
FIG. 1 is a fragmentary and partially sectional front elevation of a chair including an adjustable column of the invention.
Figure 2:
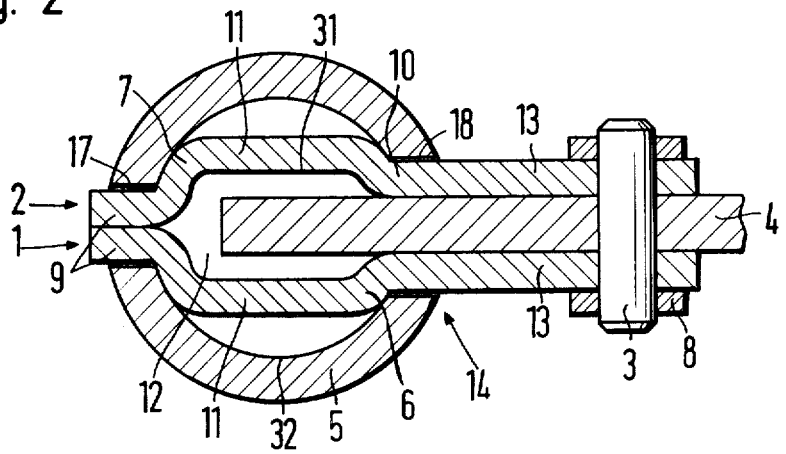
FIG. 2 shows the apparatus of FIG. 1 in fragmentary section of the line II—II.
Figure 3:
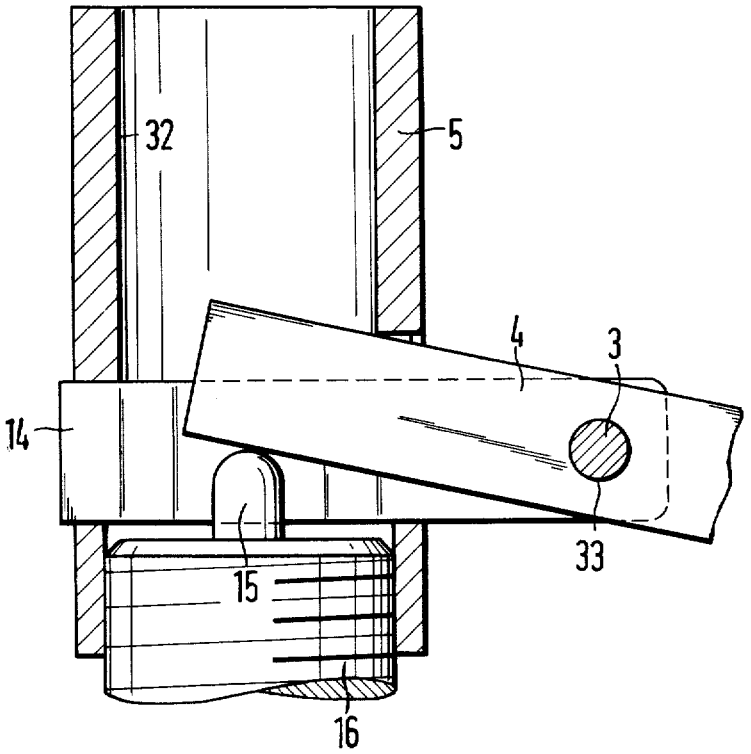
FIG. 3 illustrates a portion of the apparatus of FIG. 1 on a larger scale.
Figure 4:
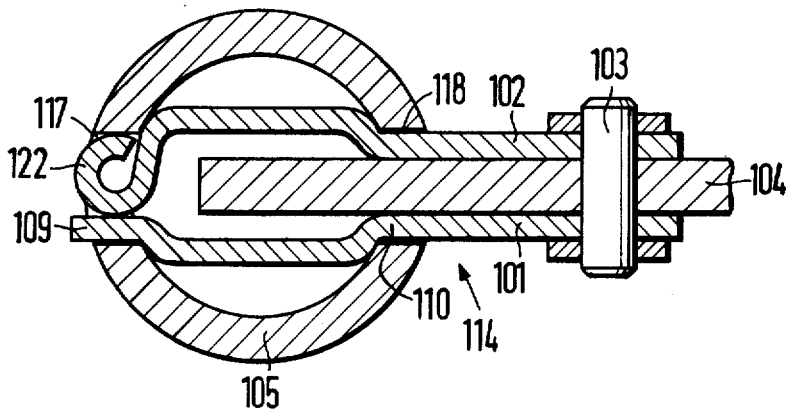
Figure 5:
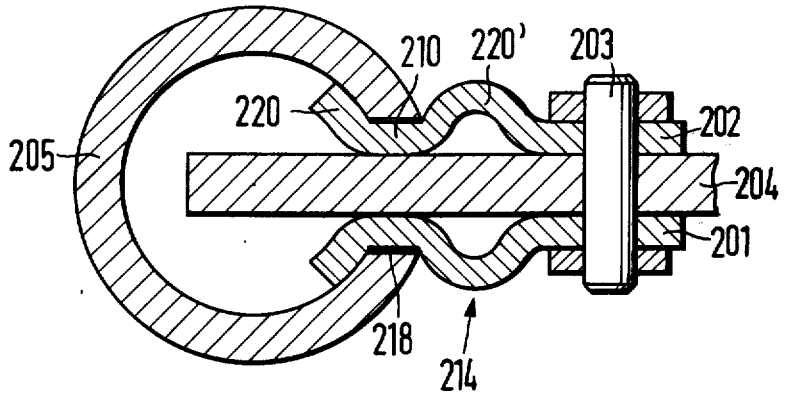
Figure 6:
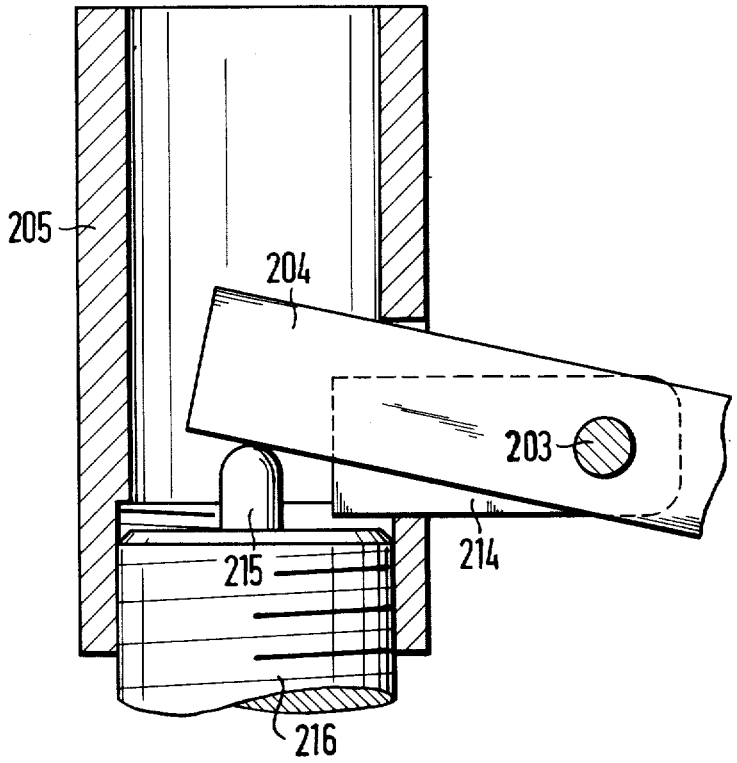
Figure 7:
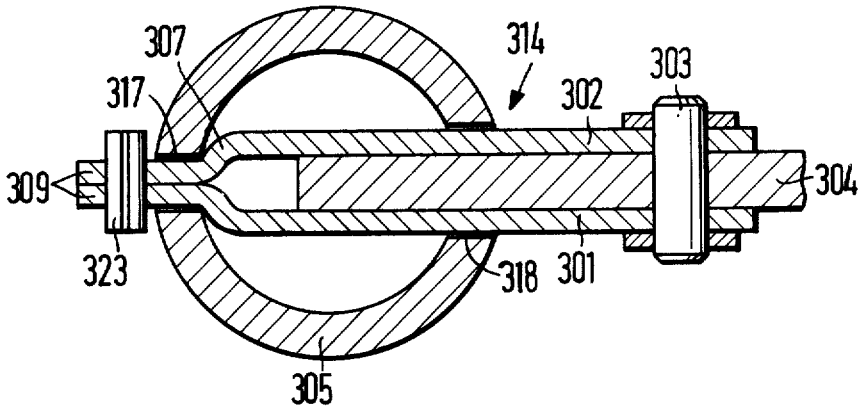
Figure 8:
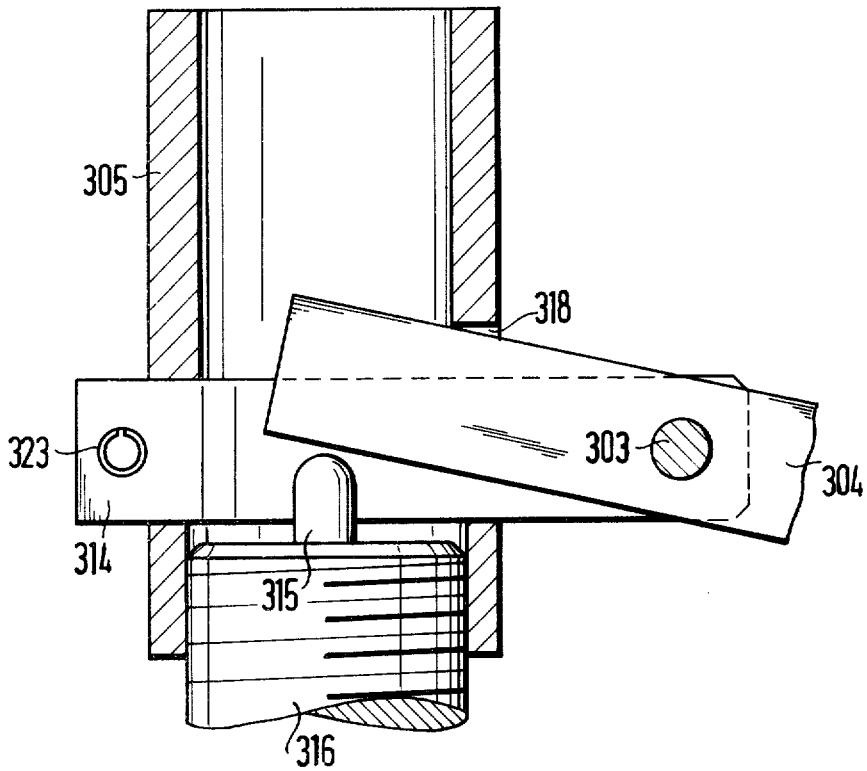
Figure 9:
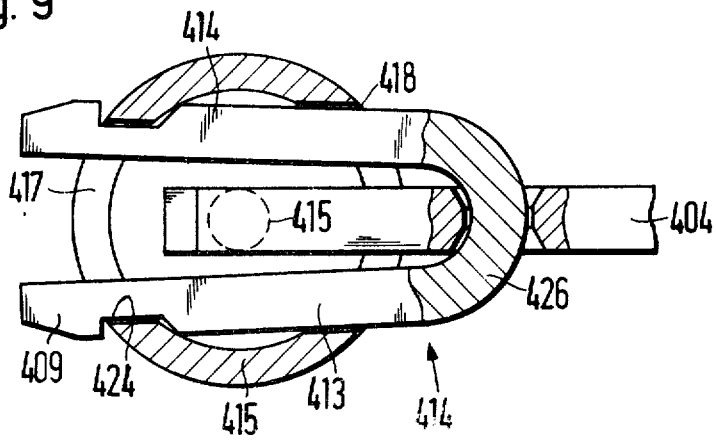
Figure 10:
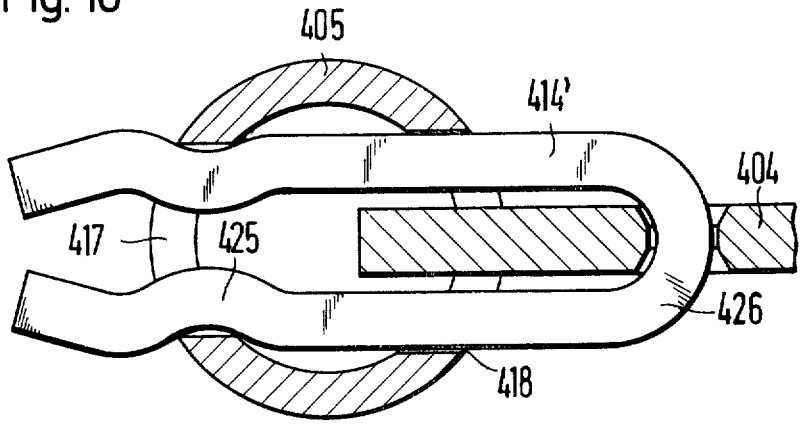
Figure 11:
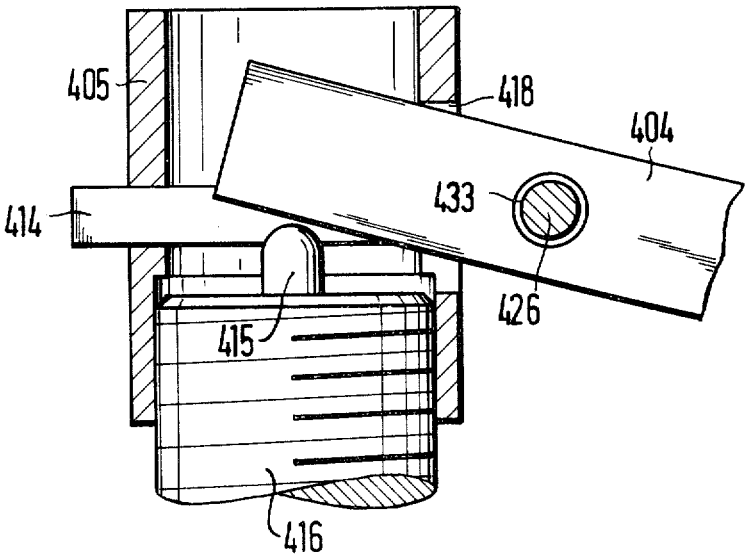

FIGS. 4, 5, 7, 9, and 10 illustrate modifications of the apparatus of FIG. 1 in views corresponding to that of FIG. 2; and FIGS. 6, 8, and 11 respectively show the devices of FIGS. 5, 7, and 9 in views corresponding to that of FIG. 3.

Referring now to the drawing in detail, and initially to to FIG. 1, there is shown as much of a chair equipped with a support column of the invention as is needed for an understanding of the latter. Four legs 29 equiangularly spaced about an upright tubular base 30 rest on a supporting floor, as is conventional and has not been shown. A cylinder 16 and a piston rod 28 constitute the basic members of the column of the invention. The cylinder is coaxially guided in the base 30 and projects from the base upward over a distance that may be adjusted. The piston rod 28 is coaxially fastened in the base 30, is received in the lower end wall of the cylinder 6 in telescoping engagement, and is fixedly fastened to a piston 35 in the cylinder. A valve connects the two cylinder compartments above and below the piston 35 in a known manner, not shown, when a control button 15 projecting axially from the upper closure of the cylinder 16 is depressed. A filling opening in the cylinder 16, normally closed by a plug 34, permits the cylinder 16 to be filled with air at a pressure substantially greater than atmospheric pressure.

A coaxial tube 5 is threadedly fastened to the top of the cylinder 16 and normally constitutes a fixed portion of the cylinder 16. Its axially terminal top end carries the partly illustrated, load bearing seat 21 of the chair, and the back of the chair may in turn be fastened to the seat 21 in a manner not directly relevant to this invention. An opening 18 and a smaller aperture 17 are formed on the same axial level in the tube 5 and diametrically opposite each other below the seat 21. A bracket 14 is partly received in the aperture 17 and passes outward of the bore of the tube 5 through the opening 18. A pivot pin 3 fastens an operating lever 4 to the bracket 14 outside the tube bore, and an inner terminal portion of the lower 4 moves axially up and down when the lever 4 pivots on the pin 3, and opens the valve 36 by abutting engagement with the control button 15 when it pivots counterclockwise, as viewed in FIG. 1.

As long as the button 15 is not pressed, the length of the column constituted by the cylinder 16 and the piston rod 28 is substantially fixed, varying to a minor extent only as the seat 21 is loaded and the gas in the cylinder is compressed. When the button 15 is pressed, gas can flow between the two compartments of the cylinder, and the piston rod 28 and cylinder 16 can be moved freely relative to each other in the direction of the common axis, normally tending to increase the length of the column by expansion of the compressed gas, but also permitting the column to be shortened by pressure applied to the seat 21.

This invention is more specifically concerned with the operating mechanism for depressing the button 15 against the restraint of the non-illustrated spring which biases the button 15 outward of the cylinder 16.

As is better seen in FIGS. 2 and 3, the bracket 14 is elongated at right angles to the column axis and longitudinally split into two identical bracket members 1, 2 which are strips of heavy, resilient sheet metal assembled in such a manner that they are symmetrical relative to the vertical plane in which the bracket 14 is split. The bracket, taken as a whole, has a first portion 10 which is received in the opening 18 with minimal circumferential, but substantial axial clearance so that its axial movement is prevented in a downward direction only by abutting engagement with the tube 5. The bracket 14 has a second portion 11 in the bore of the tube 5, and the ends 6, 7 of the portion 11 near the opening 18 and the aperture 17 respectively provide arcuate shoulders in conforming abutting engagement with the inner face 32 of the tube 5 so as to secure the bracket 14 against radial movement outward of the opening 18 and the aperture 17. A third bracket portion 13 projects radially outward of the opening 18, and a fourth bracket portion 9 is received in the aperture 17 and conformingly fills the aperture.

The bracket members 1, 2 are contiguously juxtaposed in the aperture 17 and held in contact by the confining walls of the aperture. They are spaced from each other otherwise a distance sufficient to receive the lever 4 therebetween. The pivot pin 3 passes through a bore 33 of the lever and is axially secured in the aligned bores of the bracket members 1, 2 and of the lever 4 by locking washers 8. The bracket 14 is firmly anchored in the tube 5 by the immovably secured fourth portion 9, and by multiple frictional engagement of other parts with the tube.

The bracket members in the second bracket portion 11 are spaced apart to bound an axial passage 12 aligned with the control button 15 for movement of the inner terminal portion of the lever 4. The outer terminal portion of the lever 4 has been illustrated only in part, and the omitted part carries a handle, as is known in this type of chair. When the handle is moved upward, the valve in the cylinder 16 is opened, and the height of the seat 21 may be adjusted.

As is evident from FIGS. 1 to 3, only the small third portion 13 of the bracket 14 is visible outside the column, and not conspicuous. The operating mechanism for the button 15 may be assembled and installed without tools from the bracket members 1, 2, the pivot pin 3, the lever 4 and the washers 8. The two bracket members 1, 2 are inserted one after the other through the opening 18 into the aperture 17 until the shoulders 7 of the portion 11 abut against the inner tube face 32. The outwardly projecting parts of the bracket members 1, 2 are then moved apart to permit insertion of the lever 4 and ultimate fastening of the lever between the bracket members 1, 2 by the pin 3 and the washers 8. The operation is simple, can be performed on the otherwise fully assembled chair, if so desired, and does not require any tools.

FIGS. 4 to 11 illustrate modifications of the operating mechanism described above with particular reference to FIGS. 2 and 3, and these modifications will be described as to their structure only, the operation and mode of assembly not being different from what has been stated above. Corresponding elements are designated by reference numerals differing from those of FIGS. 1 to 3 by 100, 200, 300, or 400.

The column partly shown in FIG. 4 differs from the first-described embodiment of the invention by an aperture 117 in the tube 105 which is equal in circumferential width to the opening 118. The lever 104 is fastened between bracket members 101, 102 by means of a pivot pin 103 in the same manner as described above, and the bracket 114 is anchored in the opening 118 by a bracket portion 110. The end portion 109 of the bracket member 101 corresponds closely to the fourth portion of the bracket members 1, 2, but the terminal part of the bracket member 102 in the aperture 117 is bent into the shape of a scroll 122. The steel of the members 101, 102 is resilient, and the compressed scroll 122 permits the two bracket members 101, 102 to be held very firmly in the aperture 117.

The tube 205 shown in FIGS. 5 and 6 has only one radial opening 218 in the radial plane of FIG. 5. The two sheet metal strips 201, 202 which jointly constitute the bracket 214 have respective portions 210 received in the opening 218 jointly with the lever 214 with minimal circumferential clearance, and their free end portions 220 within the bore of the tube 205 diverge in conforming, arcuate engagement with the inner face of the tube 205 to prevent radially outward withdrawal of the assembled bracket 214. Radially inward movement is prevented by bulges 220' in the portions of the members 201, 202 outside the tube 205 which are fastened to each other and to the lever 204 by the pivot pin 203, as described with reference to FIGS. 1 to 3.

The arcuate end portions 220 and the bulges 220' thus bound bights at the bracket portion 210, and the bights receive respective edge portions of the tube 205 which bound the opening 218 in a circumferential direction. As is evident from FIG. 6, the cooperation of the lever 204 with the control button 215 on the cylinder 216 is not affected by the modified contour of the bracket members 201, 202.

The tube 305 shown in FIGS. 7 and 8 is provided with an opening 318 and a diametrically opposite aperture 317, a lever 304 mounted on a pivot pin 303, and a control button 315 on a cylinder 316 substantially as described with reference to FIGS. 1 to 3.

The two sheet metal strips 301, 302 which jointly constitute the bracket 314 are of identical shape and symmetrically arranged relative to the plane in which the bracket 314 is split. The bracket members 301, 302 diverge at respective shoulders 307 near the aperture 317 and the straight end portions 309 of the bracket members which project radially outward of the aperture 317. The bracket members 301, 302 are straight from their shoulders 307 to their ends near the pivot pin 303. The bracket 314 is radially secured in the tube 305 by the shoulders 307 and by a split tubular sleeve 323 of resilient metal which passes transversely through the projecting parts of the end portions 309.

The bracket 414 illustrated in FIGS. 9 and 11 is a round bar of resilient steel bent into a U-shape. the two legs 413 of the U pass through an opening 418 and an aperture 417 in the tube 405 which are located in a common radial plane. The bight portion 426 of the U which connects the legs 413 passes through an opening 433 of the lever 404. The opening 433 flares toward its ends to permit free pivoting movement of the lever 404 on the bight portion 426. The resilient tension in the bight portion 426 is such as to press the legs 413 firmly in a circumferential direction against the edges of the tube 405 which bound the opening 418 and the aperture 417. The free end portions 409 of the legs 413 are provided with notches 424 in which the edges bounding the aperture 417 are received, thereby preventing radial movement of the installed bracket 414. The axial width of the aperture 417 is about equal to the corresponding dimensions of the end portions 409 so as axially to secure the bracket 414.

The lever 404 acts on the control button 415 on the cylinder 416 as described with reference to the other embodiments of the invention, and the mode of installing the bracket 414 after assembly with the lever 404 will be obvious from the described structure. The chair may be finished otherwise prior to manual insertion of the bracket 414 and the lever 404.

The milling of the recesses 424 into the bracket 414 is avoided in the otherwise identical operating mechanism shown in FIG. 10 in which the legs of the bracket 414' are partly offset laterally to form bulges 425 and corresponding recesses for engagement by the edges of the tube 405 which bound the aperture 417.

It is generally preferred and more convenient to make the tube 5 a separate element which is attached to the seat 21 and thereafter threadedly fastened to the cylinder 16. However, the connection between the cylinder 16 and the seat 21 may be brought about in any other convenient manner, and the tube 5 integrally connected with the cylinder 6 without otherwise changing the structure, operation, and mode of assembly of the operating mechanism.

Other changes and modifications of the disclosed apparatus will readily suggest themselves to those skilled in the art, and it should be understood that, within the scope of the appended claims, the invention may be practiced otherwise than as specifically disclosed.

What is claimed is:

1. A column of adjustable length comprising, in combination:

a. two column members elongated in the direction of a common axis and movable relative to each other in said direction in telescoping engagement,

1. one of said members being tubular, an inner axial wall of said one member defining an axial bore,

2. said one member being formed with an axially closed radial opening communicating with said bore;

b. a control element mounted on said one member in said bore for axial movement between a locking position in which relative axial movement of said members is substantially prevented, and a releasing position in which said members are free to move relative to each other;

c. an elongated bracket having a first longitudinal portion abuttingly engaging said one member in said opening and thereby preventing movement of said bracket in an axial direction, and a second longitudinal portion abuttingly engaging said inner axial wall and thereby preventing longitudinal movement of said bracket in a direction radial relative to said axis;

d. an operating member having respective terminal parts in said bore and outside said bore and passing through said opening; and e. securing means securing said operating member to said bracket for axial movement of the terminal part of said operating member in said bore in abutting engagement with said control element, whereby said control element is moved between said positions thereof by movement of said operating member.

2. A column as set forth in claim 1, wherein said bracket has a third portion projecting radially outward from said opening, and said securing means include a pivot member pivotally securing one of said terminal parts of said operating member to said third portion of said bracket.

3. A column as set forth in claim 2, wherein said one member is formed with an axially closed aperture substantially on a common axial level with said opening, said bracket having a fourth portion received in said aperture.

4. A column as set forth in claim 3, wherein said fourth portion abuttingly engages said one member in said aperture for further securing said bracket against movement relative to said one member.

5. A column as set forth in claim 2, wherein said bracket is longitudinally split into two bracket members, and said one terminal part is secured between said two bracket members.

6. A column as set forth in claim 5, wherein said one member is formed with an axially closed aperture substantially on a common axial level with said opening, said bracket having a fourth portion conformingly received in said aperture, said bracket members in said fourth portion abuttingly engaging each other, and being spaced apart in said first, second, and third portions of said bracket for passage of said operating member during the pivoting movement of the latter.

7. A column as set forth in claim 6, wherein one of said bracket members in said fourth portion is scroll-shaped.

8. A column as set forth in claim 6, wherein said bracket members diverge in said second portion of the bracket from said opening and said aperture in respective radially inward directions for engagement with said inner axial wall in said one bore adjacent said opening and said aperture.

9. A column as set forth in claim 6, wherein said bracket members diverge in a part of said second portion of the bracket contiguously adjacent said fourth portion, and are straight and parallel in the remainder of said second portion and in said first and third portions, said fourth portion projecting radially outward from said aperture, and said bracket members being secured to each other in the projecting part of said fourth portion.

10. A column as set forth in claim 6, wherein said pivot member integrally connects said bracket members, said bracket being substantially U-shaped, said bracket members constituting the leg parts of said U-shape, and said pivot member bounding the bight of the U-shape.

11. A column as set forth in claim 10, wherein said bracket members are formed with respective recesses directed away from each other, said one member having two edge portions oppositely bounding said aperture and respectively received in said recesses.

12. A column as set forth in claim 5, wherein said bracket members are each of arcuate configuration in said first portion of the bracket and define respective bights, said opening being bounded by edge portions of said one member respectively received in said bights.

13. A column as set forth in claim 1, further comprising means for fastening a load-bearing member to a portion of said one column member spaced from said opening in an axial direction away from the other column member.

14. A column as set forth in claim 1, further comprising a load-bearing member fastened to a portion of said one column member spaced from said opening in an axial direction away from the other column member.

15. A column as set forth in claim 1, further comprising a load-bearing member fastened to an axially terminal portion of said one column member remote from the other column member, said opening being axially intermediate said axially terminal portion and said other column member.

* * * * *